United States Patent [19]

Killinger

[11] Patent Number: 4,463,695

[45] Date of Patent: Aug. 7, 1984

[54] FEEDING MECHANISM FOR DOUBLE POINTED LOOPER SEWING MACHINE

[75] Inventor: Karl H. Killinger, Dover, N.J.

[73] Assignee: The Singer Company, Stamford, Conn.

[21] Appl. No.: 461,825

[22] Filed: Jan. 28, 1983

[51] Int. Cl.[3] ..... D05B 57/02; D05B 97/02; D05B 97/10

[52] U.S. Cl. ..... 112/199; 112/112; 112/169

[58] Field of Search ..... 112/70, 103, 112, 169, 112/199

[56] References Cited

U.S. PATENT DOCUMENTS

| | | | |
|---|---|---|---|
| 477,636 | 6/1892 | Blodgett | 112/70 X |
| 1,809,192 | 6/1931 | Cahill et al. | 112/169 |
| 2,969,755 | 1/1961 | Reece | 112/70 X |
| 3,165,080 | 1/1965 | Castelletti | 112/112 |
| 3,837,306 | 9/1974 | Doyel | 112/169 |
| 4,401,043 | 8/1983 | Peterson | 112/112 X |
| 4,411,210 | 10/1983 | Killinger | 112/199 |

FOREIGN PATENT DOCUMENTS

| | | |
|---|---|---|
| 5495356 | 12/1977 | Japan . |
| 5748872 | 9/1980 | Japan . |

*Primary Examiner*—Wm. Carter Reynolds
*Attorney, Agent, or Firm*—William V. Ebs; Robert E. Smith; Edward L. Bell

[57] ABSTRACT

A chain stitch sewing machine including a double pointed looper is provided with feeding mechanism in which looper motion is used in conjunction with needle motion to control the movement of work under the needle of the machine.

7 Claims, 7 Drawing Figures

Fig.4
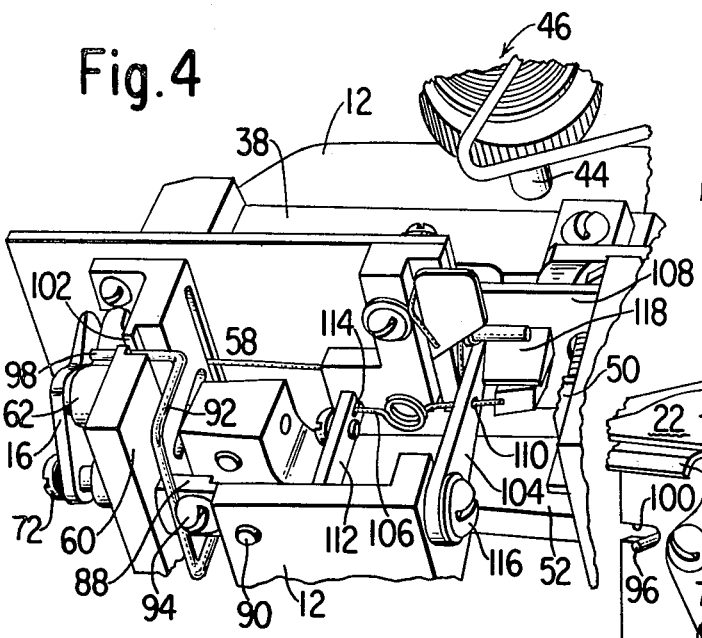
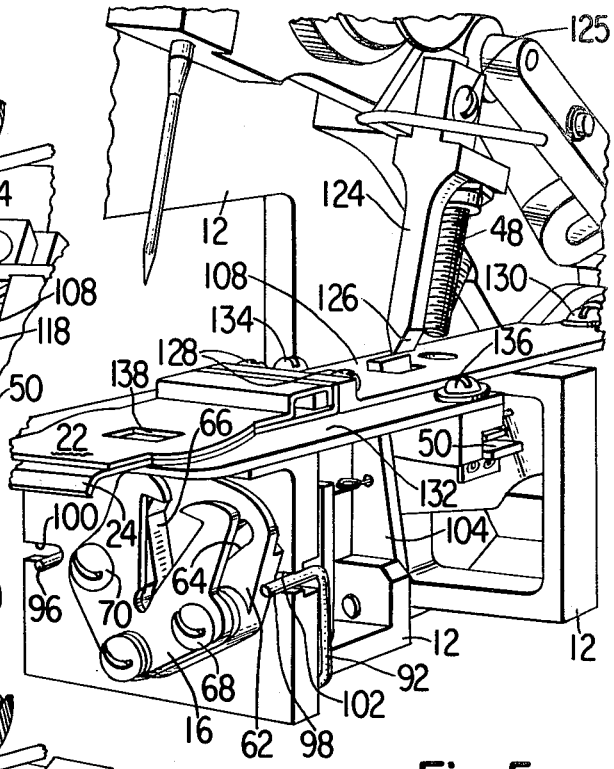
Fig.5
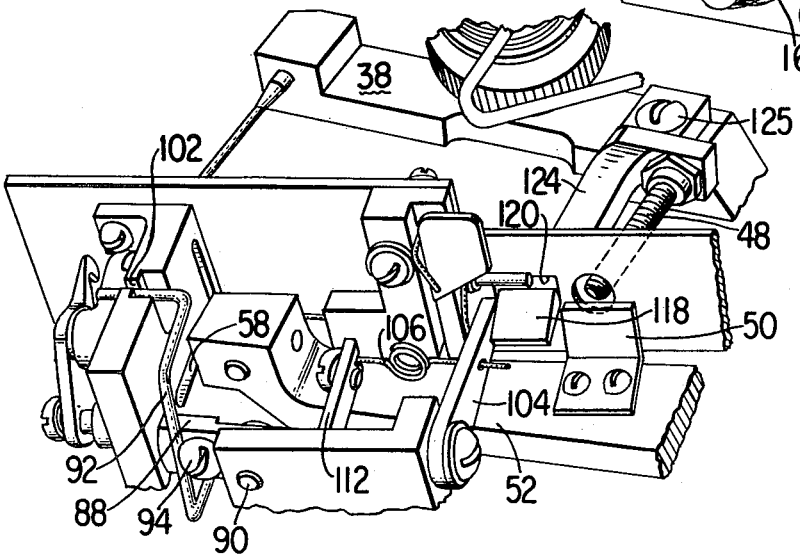
Fig.6
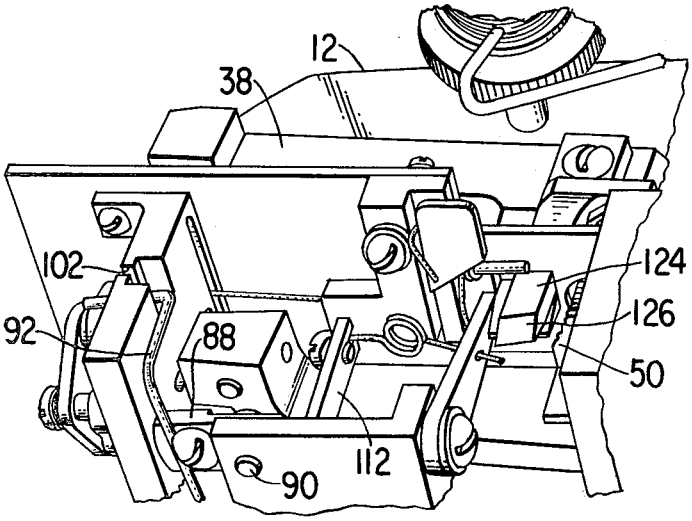
Fig.7

FEEDING MECHANISM FOR DOUBLE POINTED LOOPER SEWING MACHINE

DESCRIPTION

BACKGROUND OF THE INVENTION

1. Field of the Invention

The invention relates to chain stitch sewing machines with double pointed loopers.

2. Description of the Prior Art

Single thread, chain stitch sewing machines utilizing double pointed loopers are commonly used in machines for sewing buttons onto garments and sewing a series of substantially superimposed stitches for tacking together multiple pieces of material. Such machines may be seen, for example, in U.S. Pat. No. 2,410,679 of J. H. Pikul for "Sewing Machine" issued Nov. 5, 1946, in U.S. Pat. No. 3,837,306 of John S. Doyel for "Portable Lightweight Hand-Held Sewing Machine" issued Sept. 24, 1974, and in U.S. Pat. No. 3,165,080 of L. Castelletti for "Hand Operated Button Sewer" issued Jan. 12, 1965.

The present invention is directed to a work feeding system for a double pointed looper chain stitching machine, and has as a prime object the provision of an improved reciprocating feed which is properly timed and synchronized with respect to the operation of a double pointed looper and a sewing needle and with which work may be fed in line with looper motion.

It is another object of the invention to provide a double pointed looper chain stitching machine with an improved reciprocating feed system wherein looper motion determines the direction of feed motion executed in conjunction with the operation of the sewing needle of the machine.

Other objects and advantages of the invention will become apparent during a reading of the specification taken in connection with the accompanying drawings.

SUMMARY OF THE INVENTION

A chain stitch sewing machine with a double pointed looper is provided with a reciprocating work feeding system in which looper motion controls the direction of feed motion, and needle driving mechanism supplies the motive force needed to move the work. The system includes a feed lever which is movable in response to the operation of the looper. The feed lever is connected through a spring to a feed pawl projecting upwardly through an opening in a work clamp carrier. A plunger is provided on a needle actuating member to repeatedly move into and out of the carrier opening and to act during successive downstrokes against opposite sides of the feed pawl. The feed pawl serves to move the carrier in one direction when engaged on one side by the plunger and to move the carrier in the opposite direction when engaged on the opposite side by the plunger. Energy is stored in the spring between the looper and the feed pawl while the plunger is against the feed pawl. Such spring energy is used to move the feed pawl across the carrier opening from one side of the plunger to the other while the plunger is above the carrier opening and clear of the pawl.

DESCRIPTION OF THE DRAWINGS

FIGS. 4, 5, 6 and 7 are fragmentary perspective views showing the feeding mechanism of the invention.

DESCRIPTION OF THE PREFERRED EMBODIMENT

Figure 1:
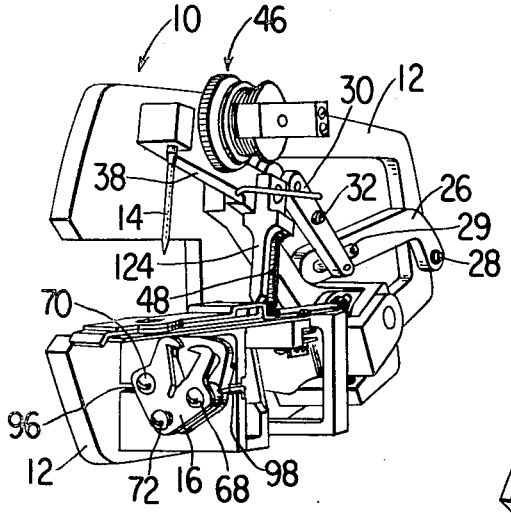
FIGS. 1 and 2 are perspective front and side views respectively, showing a machine according to the invention.
Figure 2:
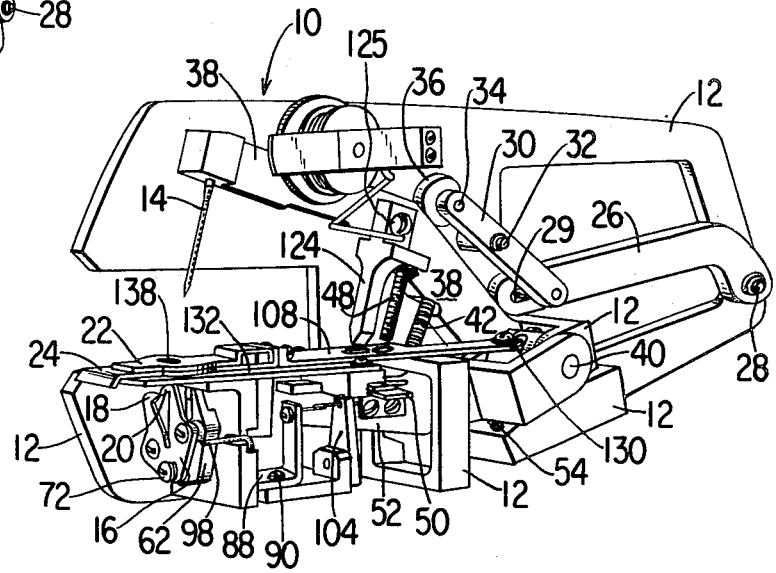
Figure 3:
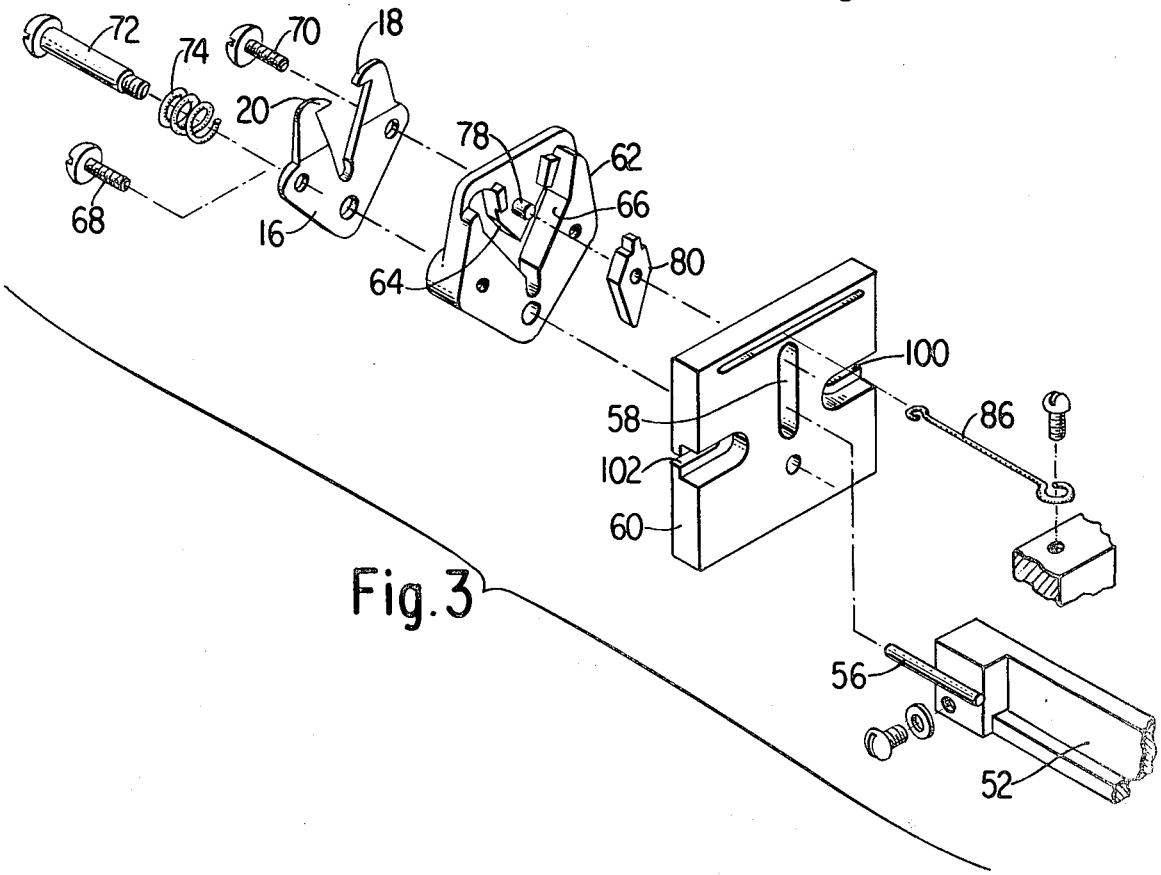
FIG. 3 is a fragmentary exploded perspective view showing the looper actuating mechanism of the machine.

Referring to the drawings, there is shown a hand held sewing machine 10 according to the invention, including a frame 12, a thread carrying needle 14 arranged for reciprocating movement and a pivotally movable looper 16 with opposing loop seizing points 18 and 20 which cooperate with the needle in the formation of chain stitches. A work clamp such as defined by members 22 and 24 is arranged to undergo movements in cooperation with those of the needle 14 and the looper to properly position work to be sewed. A hand operated lever 26 having one end pivotally attached at 28 to the frame 12 is interconnected with the needle 14 and work clamp to impart the desired movements thereto. The hand operated lever 26 also imparts movement to looper 16. The work clamp defined by members 22 and 24 is particularly suited for holding fabric layers therebetween while stitches are formed in the fabric as during a tacking operation, but may readily be modified, as for example, in the manner shown in the aforementioned U.S. Pat. No. 3,165,080 to hold both a button and fabric onto which the button is to be sewn.

As shown, lever 26 connects in a slot 29 with one end of a link 30 which is pivotally mounted on a pin 32 affixed in frame 12. A free end of link 30 includes a laterally extending pin 34 that carries a roller 36. The roller engages an arm 38 which carries needle 14 at one end and is pivotally mounted at the other end on a shaft 40 affixed in the frame 12. Arm 38 is biased upwardly by spring 42 into engagement with a stop 44 which supports a thread tensioning device 46. The arm is caused to move downwardly and dispose needle 14 for cooperation with looper 16 whenever lever 26 is squeezed upwardly. When lever 26 is released, the arm is returned to a position of engagement with stop 44 by spring 42.

Arm 38 carries a depending adjustable screw 48 which is caused during a latter portion of the descent of arm 38 to engage a flange 50 affixed to a looper drive arm 52, and move the drive arm downwardly about one end pivoted on shaft 40 against the bias of a spring 54. Spring 54 moves arm 52 upwardly as arm 38 is moved upwardly following the release of lever 26. A drive pin 56 projects outwardly from the free extremity of arm 52 and extends through a vertical pin guiding slot 58 in a guide block 60 which is rigidly attached to frame 12. Pin 56 extends beyond block 60 to engage a cam 62 along intersecting cam tracks 64 and 66 thereon. Looper 16 is affixed to cam 62 with screws 68 and 70, and the assembly is mounted on block 60 with a shouldered screw 72 and spring 74 for pivotal movement on the screw 72. Cam 62 includes a fixed pin 78 which pivotally supports a gate 80 for alternately blocking each of the two intersecting cam tracks 64 and 66 so that the drive pin 56 can slidingly engage the other track to effect pivotal motion of the looper 16 as described in my U.S. Pat. No. 4,411,210 for "Actuating Mechanism for a Double Pointed Looper in a Sewing Machine", issued Oct. 25, 1983, and as required to alternately place each of the two loop seizing points 18 and 20 on the looper into cooperative association with the needle 14 to provide for the formation of chain stitches. The gate is positioned by drive pin 56 and a spring 86 in the manner fully described in the said U.S. Pat. No. 4,411,210.

Feeding mechanism in accordance with the invention is provided for reciprocating work under the needle 14. Such feeding mechanism includes a lever 88 which is pivotally mounted on a pin 90 in frame 12, and has a member 92 affixed thereon at 94. Member 92 includes fingers 96 and 98 that extend through slots 100 and 102 respectively, in block 60 to engage opposite sides of cam 62. The feeding mechanism further includes a feed pawl 104, a wire spring 106 which connects lever 88 with the feed pawl, and a clamp carrier 108. As shown, one end of spring 106 extends through a hole 110 in pawl 104 and the other end of the spring extends through a slot 114 in an upstanding end portion 112 of lever 88 The lower end of the pawl 104 is pivoted at 116 in the frame, and a wedge-shaped upper end portion 118 projects through an opening 120 in clamp carrier 108. The width of opening 120 is sufficient to accommodate the upper end portion 118 of pawl 104 as well as a depending plunger 124 which is affixed to arm 38 with a screw 125 and is movable into and out of the opening as the arm is caused to pivot on shaft 40. Plunger 124 has a lower wedge-shaped end portion 126 as shown.

While the needle carrying arm 38 is in a raised position, the looper affixed cam 62 is in an extreme pivoted position against finger 96 or 98, and lever 88 is disposed to cause spring 106 to hold end portion 118 of pawl 104 against one side or the other of opening 120 as determined by the position of the cam 62. When arm 38 is moved downwardly by the squeezing of lever 26, plunger 124 is caused to move into opening 120. As the plunger 124 moves into opening 120, wedge edge portion 126 pushes against feed pawl 104, whereupon the pawl is caused to move carrier 108 and clamping members 22 and 24 attached thereto by screws 128 about a pivotal mounting for the carrier at 130. Fabric positioned between the clamping members is thereby moved laterally under the needle and disposed for needle penetration before the needle can enter the fabric. The carrier 108 is a rigid plate-like member slidable on the bed 132 of the machine between stops 134 and 136. Member 22 is of a resilient material and serves to resiliently,bear down upon and hold fabric in place on member 24. The carrier 108 and the clamping members include aligned openings at 138 through which the needle 14 can pass in laterally displaced positions of the carrier.

After the initial downstroke of arm 38 and upon the release of lever 26, arm 38 is moved upwardly by spring 42 to withdraw needle 14 from the fabric, and plunger 124 from opening 120. During such upward movement, looper affixed cam 62 is pivoted by drive pin 56 away from the then engaged finger on member 92, and into enforced engagement wit the other finger. Lever 88 is moved to stress spring 106 in a manner causing pawl 104 to be biased against plunger 124, and when the plunger clears the pawl the stored energy in the spring is released whereupon the pawl is moved by spring action from the one side by opening 120 to the other.

During the next downstroke of arm 38 occassioned by the squeezing of lever 26, plunger 124 acts against upper portion 118 of pawl 104 on the side opposite from that engaged by the plunger during its initial downstroke. As a consequence the pawl is caused to move carrier 108 and attached clamping members 22 and 24 along with fabric therebetween in a direction opposite to the direction in which they were moved during the initial downstroke, and the fabric is so repositioned for needle penetration.

As the arm 38 is again moved upwardly upon the release of lever 26 to thereby withdraw needle 14 from fabric and plunger 124 from opening 120, looper affixed cam 62 is pivoted by drive pin 56 away from the engaged finger on member 92 and into enforced engagement with the other finger. Lever 88 is moved to stress the spring 106 while pawl 104 is still in engagement with plunger 124 and when the plunger clears the pawl the spring moves the pawl across opening 120 to its initial position to complete an operative cycle of the machine.

It is to be understood that the present disclosure relates to a preferred embodiment of the invention which is for purposes of illustration only and is not be construed as limiting the invention. Numerous alterations and modifications of the structure herein will suggest themselves to those skilled in the art, and all such modifications and alterations which do not depart from the spirit and scope of the invention are intended to be included within the scope of the appended claims.

I claim:

1. In a sewing machine; a frame; a sewing needle; a looper with two loop siezing points; means for moving the needle and looer so as to alternately place each of the loop seizing points in cooperative association with the needle for the formation of chain stitches; a lever movable in response to the operation of the looper; a work clamp carrier with an opening therethrough; a feed pawl operably connected to the said lever and extending through the carrier opeing wherein the pawl is movable between opposite sides thereof; a member movable by the needle moving means against the pawl while the pawl is on either side of the opening to cause the pawl to move the carrier in a direction depending upon the position of the pawl in said opening, and movable thereafter out of engagement with the pawl; and a spring which is located in the connection between said lever and feed pawl and into which energy is stored by operation of the looper while the feed pawl is engaged by said member, but from which energy is extracted to move the feed pawl across the carrier opening when the plunger is disengaged from the feed pawl.

2. The combination of claim 1 wherein the said member is a plunger which is movable into and out of the carrier opening by the needle moving means.

3. The combination of claim 2 wherein the plunger includes a wedge shaped end portion movable into and out of the carrier opening.

4. The combination of claim 1 wherein the feed pawl is pivotally mounted in the frame.

5. The combination of claim 1 including a pivotally mounted arm which carries both the sewing needle and said member.

6. The combination of claim 1 including a looper cam which is affixed to the looper and is pivotally mounted in said frame, and a cam bracketing member which engages opposite sides of the looper cam and is affixed to said lever.

7. The combination of claim 1, wherein said lever is pivotally mounted in the frame.

* * * * *